US006357738B1

(12) United States Patent
Sägesser

(10) Patent No.: US 6,357,738 B1
(45) Date of Patent: Mar. 19, 2002

(54) FEEDER FOR A COLLATOR

(75) Inventor: Christoph Sägesser, Mägenwil (CH)

(73) Assignee: Grapha-Holding AG (CH)

( * ) Notice: Subject to any disclaimer, the term of this patent is extended or adjusted under 35 U.S.C. 154(b) by 0 days.

(21) Appl. No.: 09/543,887

(22) Filed: Apr. 6, 2000

(30) Foreign Application Priority Data

Apr. 6, 1999 (EP) ..... 99810283

(51) Int. Cl.[7] ..... B65H 5/00
(52) U.S. Cl. ..... 271/10.13
(58) Field of Search ..... 271/10.09, 10.13, 271/10.1

(56) References Cited

U.S. PATENT DOCUMENTS 4,043,859 A * 8/1977 Van Dam et al. ..... 156/566 X
6,082,515 A * 7/2000 Oono et al. ..... 192/69.71 X
6,115,031 A * 12/2000 Ballestrazzi et al. ..... 53/569

* cited by examiner

*Primary Examiner*—Christopher P. Ellis
*Assistant Examiner*—Kenneth W. Bower
(74) *Attorney, Agent, or Firm*—Venable; George H. Spencer; Robert Kinberg

(57) ABSTRACT

A feeder has a mechanism for individually and cyclically depositing sheets from a stack on a conveying device. A gear mechanism has a powered wheel and a power take-off wheel, and connected with the depositing mechanism. For adjusting the deposit cycle, the two wheels are rotatable in respect to each other by an adjusting device. The power take-off wheel is arranged on a hollow shaft, and this hollow shaft receives a further shaft on which the other wheel is arranged. The invention allows a rapid and exact matching of the cycle of the feeder to that of the conveying device.

13 Claims, 5 Drawing Sheets

34
24
26
24b
24a
20
15
43
2
35
23
23a
23b
40
30
61
36
38
37
39
28
29
27
21
34
24
20
15

FEEDER FOR A COLLATOR

CROSS-REFERENCE TO RELATED APPLICATIONS

Priority is claimed with respect to Patent Application No. 99810283.4 filed in the European Patent Office on Apr. 6, 1999, the disclosure of which is incorporated herein by reference.

FIELD OF THE INVENTION

The invention relates to a feeder for a collator, having means for depositing sheets from a stack individually and cyclically onto a conveying device, having a gear mechanism with a powered wheel and a power take-off wheel, which are connected with the depositing means.

BACKGROUND OF THE INVENTION

Feeders of this type have been produced by the assignee herein for a long time and are used for individually depositing sheets from a stack of a sheet magazine to a collecting chain. Following their removal from the stack, the folded sheets are opened by two opening drums and are dropped, straddling two catches of the collecting chain, onto the latter. So that these sheets are deposited precisely between two catches, the cycle of the feeder must be matched to the cycle of the collecting chain. An imprecise setting results in sheets being dropped off the collecting chain, which means an interruption in any case. An exact match is particularly important if a very large output is required, and if the distance between two adjoining catches of the collecting chain is not much greater than the width of the sheets. Thus, the depositing of the sheets on the collecting chain in a way wherein the cycle is as precise as possible is essential for a large output and functional dependability of a sheet collating machine.

Up to now it was necessary to turn off a device in order to match its cycle to the collecting chain, and the feeder had to be uncoupled from the gear mechanism. After adjusting the gear mechanism, it was connected again and the adjustment was checked with the machine running. As a rule it had been necessary up to now to connect and disconnect several times before the desired matching of the cycles had been achieved. This matching was particularly time-consuming in cases where a collating machine had several feeders. Moreover, the matching was not only comparatively elaborate, but also not precise since.

OBJECT AND SUMMARY OF THE INVENTION

An object of the invention is to provide a feeder of the type mentioned in which the cycle can be matched more simply and rapidly to that of the conveying device.

The above and other objects are achieved in accordance with the invention by the provision of a feeder for a collator, comprising means for depositing sheets from a stack individually and cyclically onto a conveying device; a gear mechanism having a powered wheel and a power take-off wheel which are connected with the depositing means; and an adjusting device with which the powered wheel and the power take-off wheels are rotatable in relation to each other for adjusting a deposit cycle of the feeder.

Accordingly, the feeder of the invention has an adjusting device, by means of which the powered wheel and the power take-off wheel of the gear mechanism can be displaced in relation to each other. With such an adjustment device, an adjustment is possible while running the conveying device.

An adjustment while running is not only simpler and faster, but also more accurate, since it is immediately possible to check the effect of the adjustment. Moreover, the adjustment-of the cycle is continuous, since such an adjustment device can be independent of the pitch.

Preferably the conveying device is a collecting chain, however, it can also be an opening drum, for example.

The feeder is preferably a folding feeder with a draw-off drum and two opening drums, but this is not absolutely required. The feeder can also be embodied as an insetting machine.

A particularly advantageous embodiment of the adjusting device results if, in accordance with a further development of the invention, one of the two wheels is arranged on a hollow shaft, and this hollow shaft receives a further shaft, on which the other wheel is arranged. These two shafts are displaced in respect to each other in one or the other direction for adjusting the cycle. In accordance with a further development of the invention, this takes place by means of an engagement element, which preferably can be displaced along the two hollow shafts, and which projects through slits in the two hollow shafts. One of these slits is preferably spirally shaped.

A particularly exact and simple cycle adjustment results if, in accordance with a further development of the invention, the engagement element can be continuously displaced in the longitudinal direction of the two shafts by a threaded spindle. The engagement element can be very exactly displaced by turning the threaded spindle, and thus the two shafts can be turned in respect to each other.

In accordance with a further development of the invention, a coupling is installed in the powered wheel. This results in a particularly compact structure.

The coupling is preferably designed so that it limits the torque.

If, in accordance with a further development of the invention, the torque can be controlled, it is possible to match the maximum torque optimally to the product to be deposited.

In accordance with a further development of the invention, the regulation of the torque is performed by compressed air, which allows a particularly simple and dependable regulation.

The design of the coupling allows a recoupling in the exact cycle.

An exemplary embodiment of the invention will be explained in greater detail in what follows, making reference to the drawings.

DETAILED DESCRIPTION OF THE PREFERRED EMBODIMENT

Figure 1:
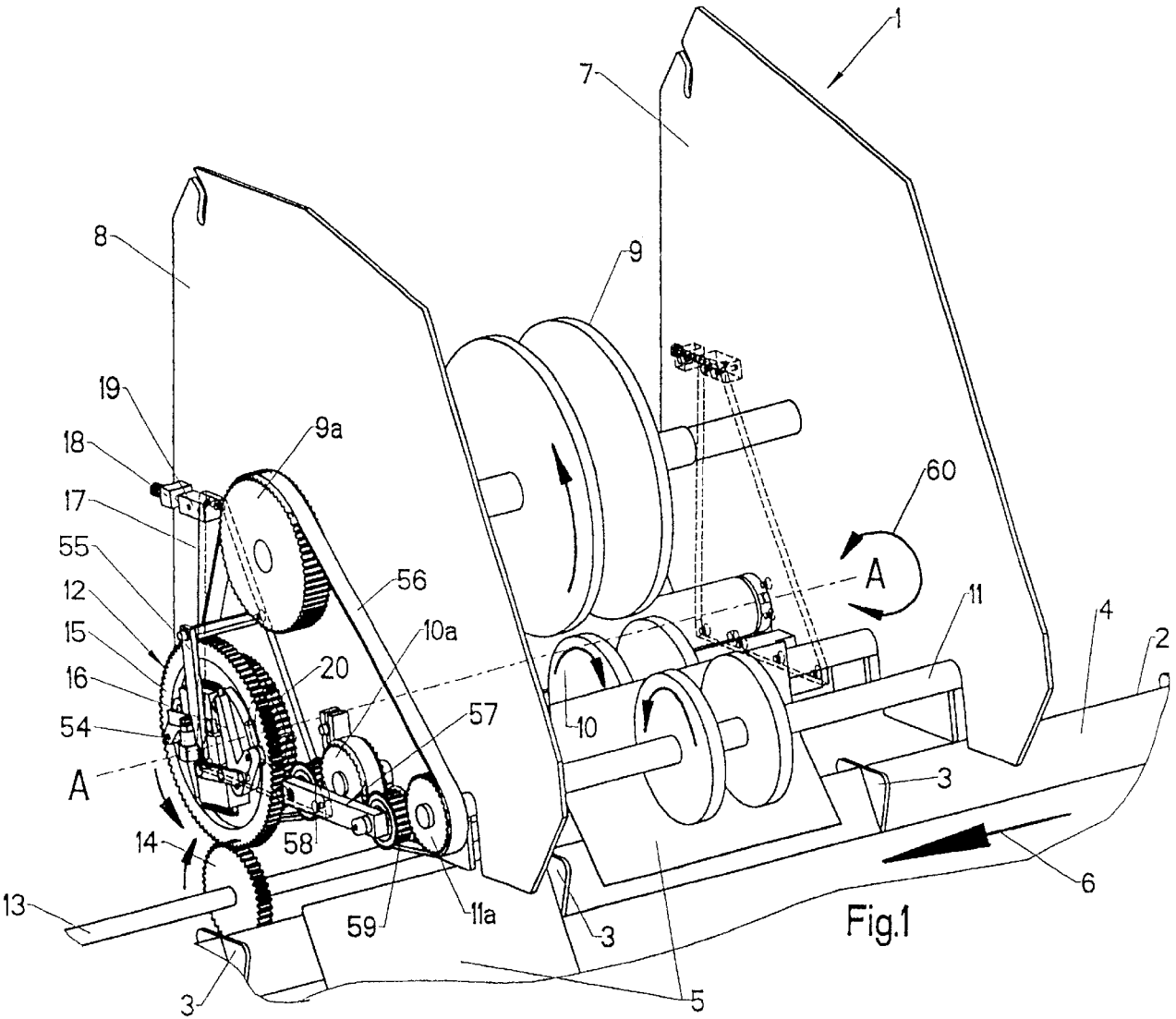
FIG. 1 schematically represents a perspective view of a feeder in accordance with the invention, as well as a portion of a collecting chain.

Referring to FIG. 1, there is shown a feeder 1 including two end plates 7 and 8, which are arranged parallel to and spaced apart from each other, and which are pivotally seated around an axis A on a support 17. In accordance with FIG. 2, this support 17 is U-shaped in cross section and has a horizontally extending plate 17*a* as a base. A catch 18 for the end plate and a catch 19 for the support 17 are arranged on the end plates 7 and 8, respectively. The pivot directions of end plates 7 and 8 are indicated by the two-headed arrow 60.

Sheets 5 are drawn off between two end plates 7 and 8 from a stack, not represented here, by a draw-off wheel 9, known per se. The drawn-off sheets 5 are grasped by two opening drums 10 and 11 and, as shown in FIG. 1, are deposited from the top to the bottom straddling a collecting chain 4 of a conveying device 2. With collecting chain 4 running, sheets 5 are deposited between two catches 3. In accordance with the arrow 6 in FIG. 1, the conveying direction of collecting chain 4 is from right to left. When a sheet 5 has been deposited on collecting chain 4, it is grasped by the rear catch 3 and taken along. If a sheet 5 is deposited too early or too late, it drops on a catch 3, which results in an interruption.

For turning the draw-off wheel 9, as well as the two opening wheels 11 and 10, respective pinion gears 9*a*, 10*a*, and 11*a* are arranged outside of end plate 8. An endless drive belt 56, provided with teeth on both sides, connects pinion gears 9*a*, 10*a* and 11*a* with a power take-off wheel 20 of a gear mechanism 12. A powered wheel 15 is arranged on the shaft of power take-off wheel 20 and meshes with a pinion gear 14 of a driveshaft 13. Shaft 13 is driven by a motor, not represented here.

A tensioning device 57 is attached to the outside of the end plate 8 for tensing drive belt 56. This tensioning device 57 has a gear wheel 59, fixed in place on the frame, as well as an adjustable gear wheel 58, arranged at a distance.

Figure 2:
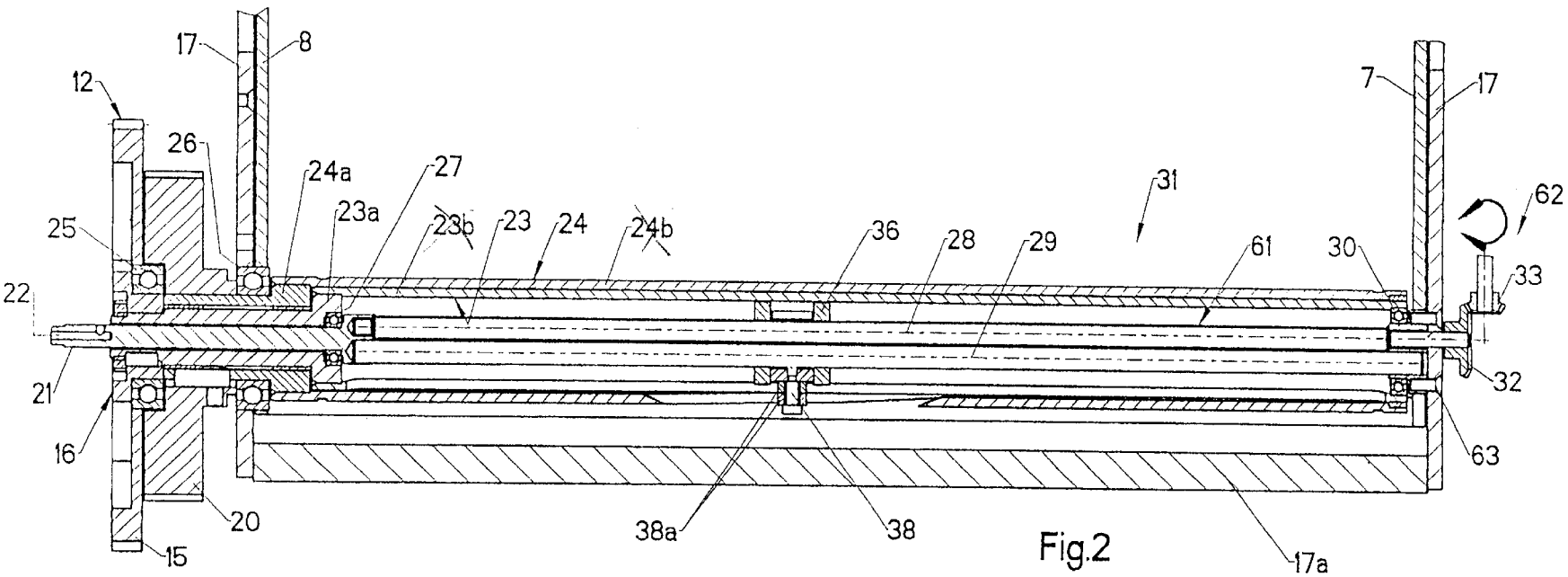
FIG. 2 shows an axial section through a portion of the feeder.

In accordance with FIG. 2, an adjusting device 31 is seated on support 17, by means of which powered wheel 15 and the power take-off wheel 20 can be adjusted in respect to each other and while they are running. Adjusting device 31 essentially consists of an inner hollow shaft 23, an outer hollow shaft 24, an adjusting element 61, as well as a hand-operated driving gear 62. The two hollow shafts 23 and 24 are arranged coaxially in respect to each other. The outer hollow shaft 24 is connected, fixed against relative rotation, to the power take-off wheel 20 by a connecting sleeve 24*a*. The connection between connecting sleeve 24*a* and power take-off wheel 20 takes place by means of a wedge 24*b* represented in FIG. 3*a*. The outer shaft 24 has an exterior tube which, in accordance with FIG. 2, extends between the two end plates 7 and 8 and rests, displaceable in the circumferential direction, against the exterior of a coaxial tube of the inner hollow shaft 23.

Figures 3A, 3B:
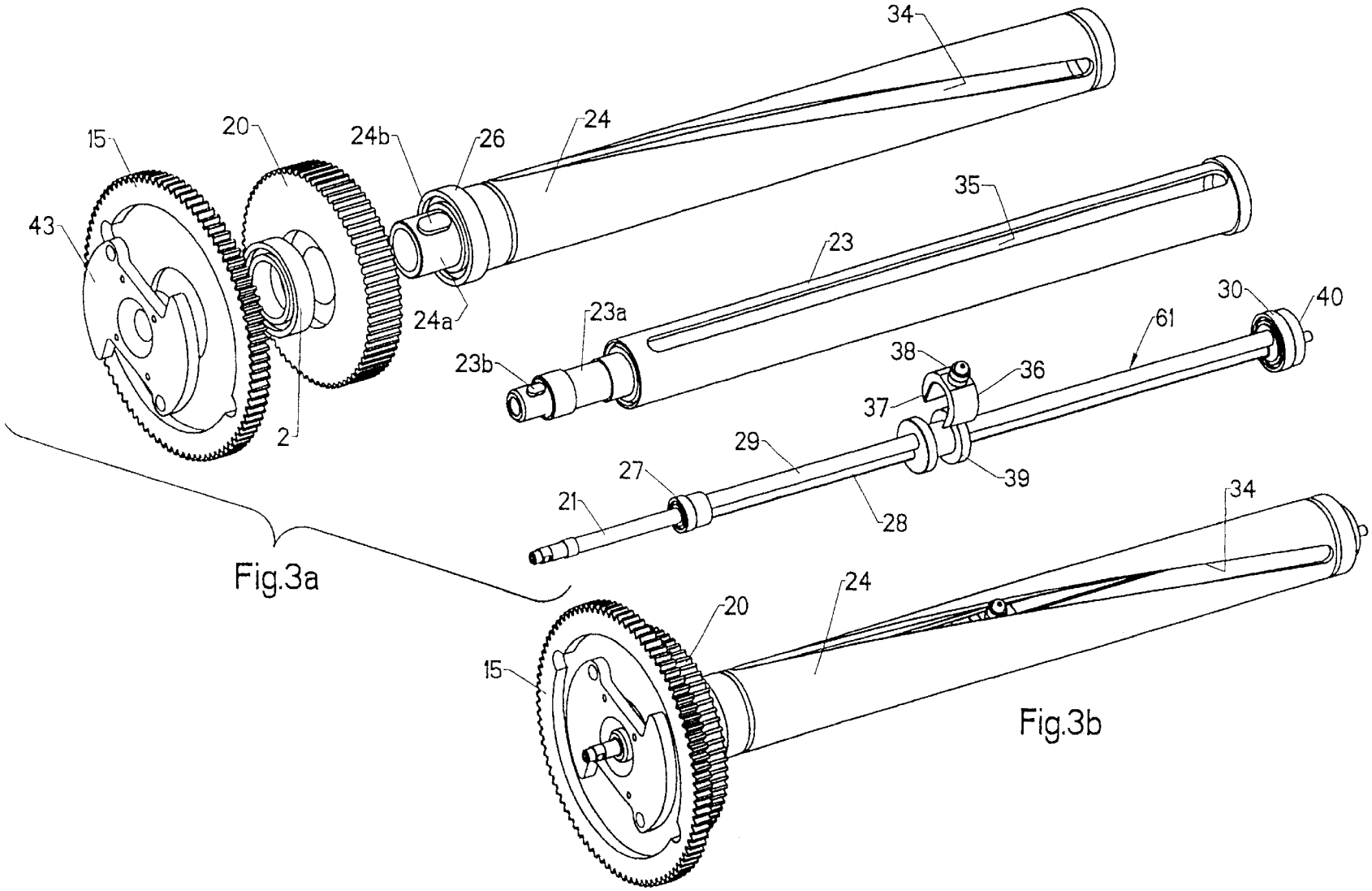
FIG. 3*a* is a perspective view of exploded parts of the feeder.
FIG. 3*b* represents the parts in FIG. 3*a* in an assembled state.

Tube 23 is fixedly connected with the powered wheel 15 by means of a sleeve-shaped connecting element 23*a* and a connecting wedge 23*b* (FIG. 3*a*). The end of tube 23 on the right in FIG. 2 is arranged, rotatable by means of a bearing 30, on a bearing sleeve 40 (see FIG. 3*a*), which is fixedly connected with the support 17 by means of screws 63 (FIG. 2).

Adjusting element 61 extends in the interior of the inner hollow shaft 23 and has a guide spindle 29, as well as a threaded spindle 28. In accordance with FIG. 2, these are attached with their left ends on a support 21, which extends through the connecting element 23*a* and has an air connector 22 on an end which projects past the powered wheel 15. In accordance with FIG. 2, adjusting element 61 is connected, fixed against relative rotation, with support 17 by means of an angle-shaped element 55. Adjusting element 61 is supported in connecting element 23*a* by a bearing 27. A further bearing 26 supports connecting sleeve 24*a* on support 17.

Guide spindle 29 and threaded spindle 28 extend through a cylindrical sliding body 39, on which an engagement element 36 has been placed, which has a fork 37, as well as a finger 38. Threaded spindle 28 is in threaded engagement with sliding body 39. When turning threaded spindle 28 by way of a hand-operated driving gear 62 (see FIG. 2), engagement element 36 is displaced to the left or right. The hand-operated driving gear 62 has, for example, two bevel wheels 32 and 33 meshing with each other. In principle, hand-operated driving gear 62 can also be replaced by a drive motor.

Finger 38 of the engagement element 36 extends radially through a straight slit 35 of inner hollow shaft 23, as well as a spirally shaped slit 34 of outer hollow shaft 24. Both slits 34 and 35 essentially extend over the entire length of tube 23 and 34, respectively. Threaded spindle 28, as well as guide spindle 29 also extend over the length of these slits.

The inner hollow shaft 23 constitutes a driveshaft and is connected with powered wheel 15 via a coupling 16. The connection is made via connecting element 23*a*, which engages a coupling body 43 by way of wedge 23*b* already mentioned above. Hollow shaft 23 is connected with connecting element 23*a* and fixed against relative rotation, for example by being pressed on.

Figure 4:
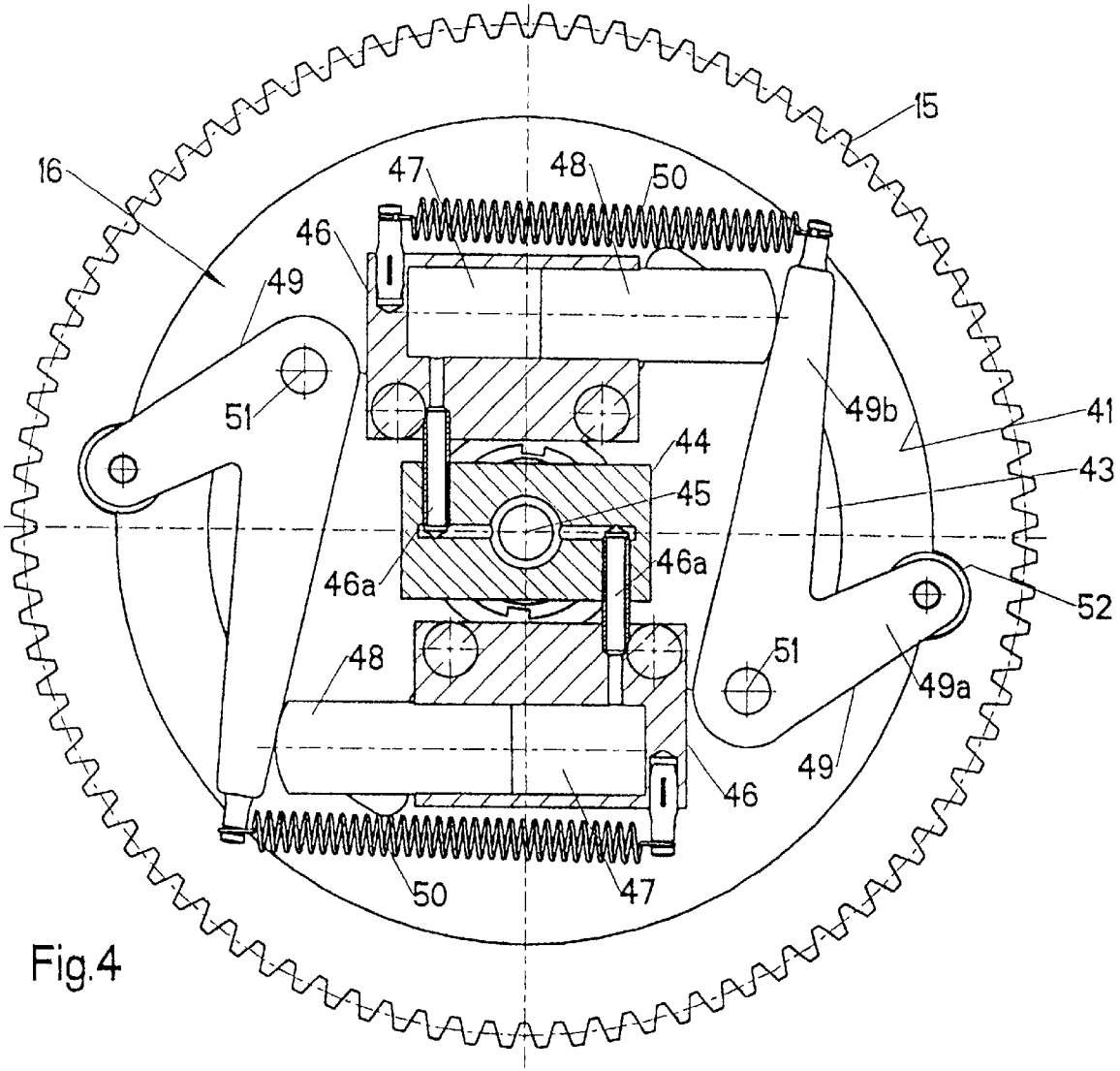
FIG. 4 schematically shows a side elevation of a powered wheel with a coupling installed and in an engaged state.
Figure 5:
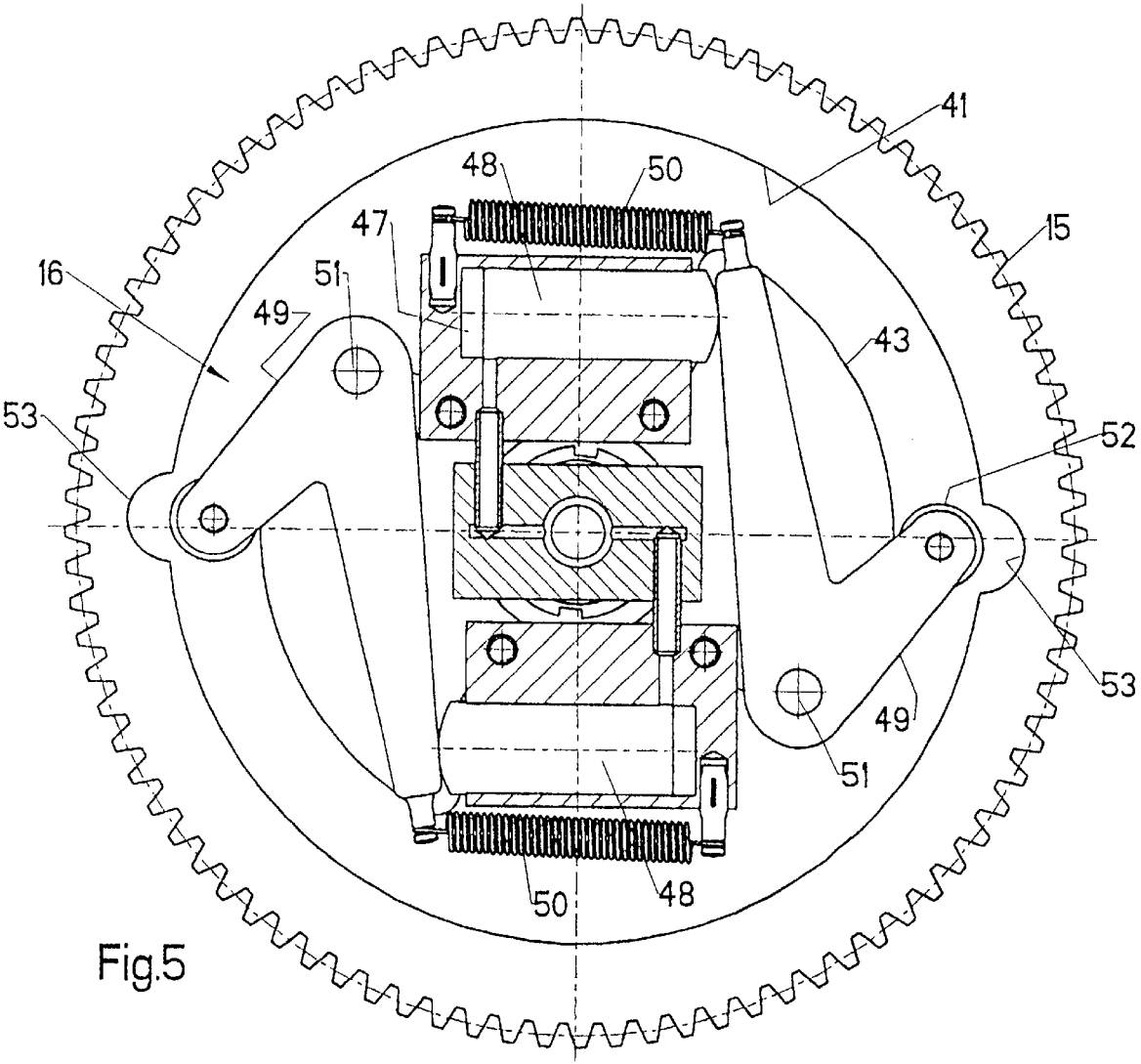
FIG. 5 shows the coupling in accordance with FIG. 4 in a disengaged state.

With reference to FIGS. 4 and 5, two identical coupling levers 49, which are located diametrically opposite each other, are pivotally seated on coupling support 43 by way of hinge bolts 51. Two cylinder blocks 46, also located diametrically opposite each other, are fastened on coupling support 43. These blocks 46 each receive a cylinder 48, which is displaceably seated in a pressure chamber 47. Each pressure chamber 47 is connected via a line 46*a* with a central air conduit 45. Air conduit 45 is, in turn, connected with a compressed air hose, not represented here, via the above mentioned air connector 22, as well as via an air coupling 54 indicated in FIG. 1. The same air pressure therefore always prevails in both chambers 47. The two coupling levers 49 each have two arms 49*b* and 49*a*, which are of uneven length, as illustrated, and form an acute angle. The respectively longer arm 49*b* is connected with a tension spring 50, which pulls coupling lever 49 on longer arm 49*b* against piston 48. A roller 52 is seated on the respectively shorter arm 49*a*, which is embodied to correspond with two coupling grooves 53 of powered wheel 15 located diametrically opposite each other (see FIG. 5).

If the air pressure in the two pressure chambers 47 is so great that the force of the pistons 48 is greater than the pulling force of the two tension springs 50, the pistons 48 exert a torque in a clockwise direction on coupling levers 49 as shown in FIG. 4. If coupling grooves 53 are located at the height of the rollers 52, these rollers 52 snap into the coupling grooves 53 and in this way connect the coupling support 43, or respectively the inner hollow shaft (driveshaft) 23, with powered wheel 15. If a defined torque between inner hollow shaft 23 and powered wheel 15 is exceeded, the two pistons 48 can no longer hold the coupling levers 49 in the position shown in FIG. 4, and rollers 52 are deflected radially inward and leave coupling grooves 53 as shown in FIG. 5. The coupling levers 49 are pivoted counterclockwise around the hinge bolts 51 in the course of this. A predetermined, very exact torque limitation is provided by this. It is regulated by the air pressure in the two pressure chambers 47. The pressure in these chambers 47 is regulated by a regulating arrangement, not represented here, and is indicated in a manner known per se on a pressure gauge, also not represented here. The coupling moment can be optimally adjusted to the product, or respectively the sheets 5, by changing the air pressure. With comparatively thin sheets 5, an air pressure of 4 bar or less, for example, is set. With sheets 5 of thicker paper a correspondingly higher air pressure is exerted, and the coupling moment is accordingly greater. The air pressure, and therefore the coupling moment, can be adjusted while running. As can be seen, the coupling operates on a 180° cycle. The cycle is exactly regained with each coupling-in process.

For uncoupling, the air pressure in the chambers 47 is reduced. Because of the pulling force of the two springs 50, the two pistons 50 move into the position represented in FIG. 5. In the process, the two coupling arms 49 are pivoted counterclockwise and rollers 52 are moved radially out of grooves 53. FIG. 5 shows the coupling 16 in the uncoupled state. When coupling, the relative position in the 180° cycle between powered wheel 15 and shaft 23 is automatically and exactly regained by rollers 52 snapping into the coupling grooves 53. As can be seen, coupling 16 is housed and integrated in a recess 41 of powered wheel 15. This results in a particularly compact structure.

As already mentioned above, it is essential for the invention that the cycle of feeder 1 be adjusted to the cycle of conveying device 2. This adjustment is performed at drive 62 which, for example, is a hand-operated driving gear. In this case bevel wheel 33 is turned in a clockwise or counterclockwise direction, and bevel wheel 32 is turned by way of threaded spindle 28. When turning threaded spindle 28, engagement element 36 in FIG. 2 is moved to the left or the right. Now, since slit 35 is straight and extends in the axial direction, and slit 34 extends obliquely in a spiral shape in respect to the axial direction, a relative turning of the two shafts 23 and 24 in respect to each other takes place in the course of such a displacement of engagement element 36.

The threaded spindle 28, as well as the step-down of the drive 62, permit a very delicate displacement of the engagement element 36, and therefore a very precise and fine turning of the shafts 23 and 24 in respect to each other. If the powered wheel 15 is connected, the outer driveshaft 24 is rotated when the engagement element 36 is displaced. By means of this the drive element 56 is correspondingly displaced via the power take-off wheel 20 and, along with it, the draw-off wheel 9, as well as the two opening wheels 11 and 10, are rotated. A rotation of the wheels 9 to 11 in one direction has the result that the sheets 5 are dropped earlier, and a rotation in the opposite direction has the result that the sheets 5 are dropped later. The drop position of the sheets 5 between adjoining catches 3 is changed by means of this. Thus, in FIG. 1 the drop position of the sheets 5 is displaced to the left or right. Now, since such a displacement is possible while the machine is running, it is possible to immediately detect the result of such a displacement, and it can be corrected, if necessary. As mentioned, adjusting device 31 with drive 62 and spindle 28 permit a very fine adjustment. This in turn makes it possible to arrange catches 3 at shorter distances from each other, which results in an increase in output. The invention therefore permits a very rapid and exact setting of the feeder 1. As a rule several, for example ten or more, feeders 1 are provided at a collecting chain. These are adjusted individually and in sequence by means of adjusting device 31. In this way a savings in time in the course of set-up are multiplied.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A feeder for a collator, comprising:

means for depositing sheets from a stack individually and cyclically onto a conveying device;

a gear mechanism having a powered wheel and a power take-off wheel which are connected with the depositing means; and an adjusting device with which the powered wheel and the power take-off wheels are rotatable in relation to each other for adjusting a deposit cycle of the feeder, the adjusting device including a hollow shaft having an interior space and a further shaft arranged in the interior space of the hollow shaft, wherein one of the wheels is arranged on the hollow shaft and the other one of the wheels is arranged on the further shaft, the further shaft comprising a hollow shaft, wherein the adjusting device further includes a displaceably guided engagement element, the shaft and the further shaft being connected with each other by the displaceably guided engagement element, and wherein at least one of the shafts includes at least one slit and the engagement element engages the at least one slit of the at least one shaft.

2. The feeder in accordance with claim 1, wherein the adjusting device includes a hollow shaft having an interior space and a further shaft arranged in the interior space of the hollow shaft, and one of the wheels is arranged on the hollow shaft and the other one of the wheels is arranged on the further shaft.

3. The feeder in accordance with claim 2, wherein the further shaft comprises a hollow shaft.

4. The feeder in accordance with claim 3, wherein the adjusting device further includes a displaceably guided engagement element, wherein the shaft and the further shaft are connected with each other by the displaceably guided engagement element.

5. The feeder in accordance with claim 4, wherein at least one of the shafts includes at least one slit and the engagement element engages the at least one slit of the at least one shaft.

6. The feeder in accordance with claim 1, wherein the adjusting device further comprises a threaded spindle operatively arranged for continuously displacing the engagement element in a longitudinal direction of the two shafts.

7. The feeder in accordance with claim 1, wherein the powered wheel is arranged on the further shaft and further comprising a coupling installed in the gear mechanism for coupling the further shaft to the powered wheel.

8. The feeder in accordance with claim 7, wherein the coupling is installed in the powered wheel.

9. The feeder in accordance with claim 7, wherein the coupling limits torque between the further shaft and the powered wheel.

10. The feeder in accordance with claim 9, wherein the coupling includes compressed air means for matching the torque of the coupling to the printed products.

11. The feeder in accordance with claim 7, further including means for switching in the coupling with an exact cycle of the feeder.

12. The feeder in accordance with claim 1, wherein the conveying device comprises a collecting chain, the depositing means includes a draw-off wheel and two opening wheels, and the gear mechanism includes a drive element for driving the draw-off wheel and the two opening wheels, the drive element being in engagement with the powered wheel.

13. The feeder in accordance with claim 1, including means for pivoting the depositing means about the longitudinal axis of the hollow shaft for height adjustment of the depositing means.

* * * * *